United States Patent [19]

Maier et al.

[11] Patent Number: 5,018,743

[45] Date of Patent: May 28, 1991

[54] BOARD GAME

[75] Inventors: Steven E. Maier; Helmut W. Maier, both of Waterloo, Canada

[73] Assignee: Brainy Toys Inc., Kitchener, Canada

[21] Appl. No.: 509,587

[22] Filed: Apr. 11, 1990

[30] Foreign Application Priority Data

Apr. 19, 1989 [CA] Canada ..... 597219

[51] Int. Cl.[5] ..... A63F 3/00

[52] U.S. Cl. ..... 273/242; 273/275; 273/283; 273/284; 273/258; 273/153 S

[58] Field of Search ..... 273/275, 284, 283, 287, 273/271, 153 S, 258, 242

[56] References Cited

U.S. PATENT DOCUMENTS

| | | | |
|---|---|---|---|
| 2,162,876 | 6/1939 | Barton | 273/275 |
| 3,741,545 | 6/1973 | Weisbecker | 273/283 |
| 4,032,151 | 6/1977 | Morse | 273/282 |
| 4,303,246 | 12/1981 | Strongin | 273/271 |
| 4,346,889 | 8/1982 | Barlow et al. | 273/284 |

FOREIGN PATENT DOCUMENTS

| | | | |
|---|---|---|---|
| 2161084 | 1/1986 | United Kingdom | 273/271 |
| 2200292 | 8/1988 | United Kingdom | 273/275 |

*Primary Examiner*—Benjamin Layno

*Attorney, Agent, or Firm*—Anthony Asquith & Co.

[57] ABSTRACT

A foldable baseboard is provided with sixteen fixed tablets, arranged in regular rows. Thirty-three movable tablets are placed in the spaces between the fixed tablets, to make a 7×7 square. The tablets are marked out with roads to define paths along which counters may be moved, towards a target tablet. One extra movable tablet is provided, by means of which a player can push a row of the movable tablets, thus improving the road layout, and enabling him to move his counter towards the target. The game apparatus includes target cards, and game money.

13 Claims, 4 Drawing Sheets

BOARD GAME

This invention relates to a game of the kind in which players move game pieces over the board.

The apparatus required for the game of the invention includes a baseboard, and a series of tablets which are laid out on the baseboard, preferably in regular rows. The tablets are marked out with roads, or other path-defining means, arranged in such a way that either a passable pathway is established between adjacent or neighbouring tablets, or no pathway is established.

In the game of the invention, each player chooses or is allotted a target tablet and a game counter, and the player endeavours to move his counter towards his allotted target, using the pathways established between the tablets. In the invention, some of the tablets are movable, and players can manipulate the movable tablets so as to create more favourable pathways.

In order to define the manner in which the movable tablets are permitted to move, preferably some of the tablets are fixed to the baseboard, in rows that are regularly spaced apart. The movable tablets can then run in the corridors created between the rows of fixed tablets.

In the game of the invention, the players attempt to move their counters from tablet to tablet, along the pathways, towards the target, which preferably are formed by target tablets. Preferably, the game is so arranged that each player aims at a different target. Target tablets may be identified by emblems placed upon the appropriate tablets.

Preferably, game cards are provided as a convenient means for allotting the targets to the players. The cards may be dealt out, or each player may select a card. The game can be played with the targets either disclosed to the rest of the players or kept secret until attained.

The pathways of the invention, as described, may be formed by printing roadway-like markings on the surface of each tablet. Depending on how the tablets are arranged, either at random during initial setting up, or as a result of repeated movements of the tablets by the players as the game progresses, the roadway-like markings will in some cases provide a continuous path leading from one tablet to another, along which a player may move his counter, while in other cases the markings will provide a barrier between the tablets.

It is contemplated in the invention that there are other ways in which the pathways of the invention might be constituted. For example, the tablets may be provided each with a letter, and a player may move his counter from tablet to tablet in accordance as the letters over which he passes make up a recognisable word.

However, the marked-out roadways are preferred. With the marked-out roadways, it is easy to set the skill level of the game so that even to a beginner or a casual player it is apparent that it is better to approach play with some thought for strategy, while yet to the expert player the strategy is subtle enough to require his continued attention.

DETAILED DESCRIPTION OF PREFERRED EMBODIMENT

By way of further explanation of the invention, an exemplary embodiment of the invention will now be described with reference to the accompanying drawings, in which.

Figure 1:
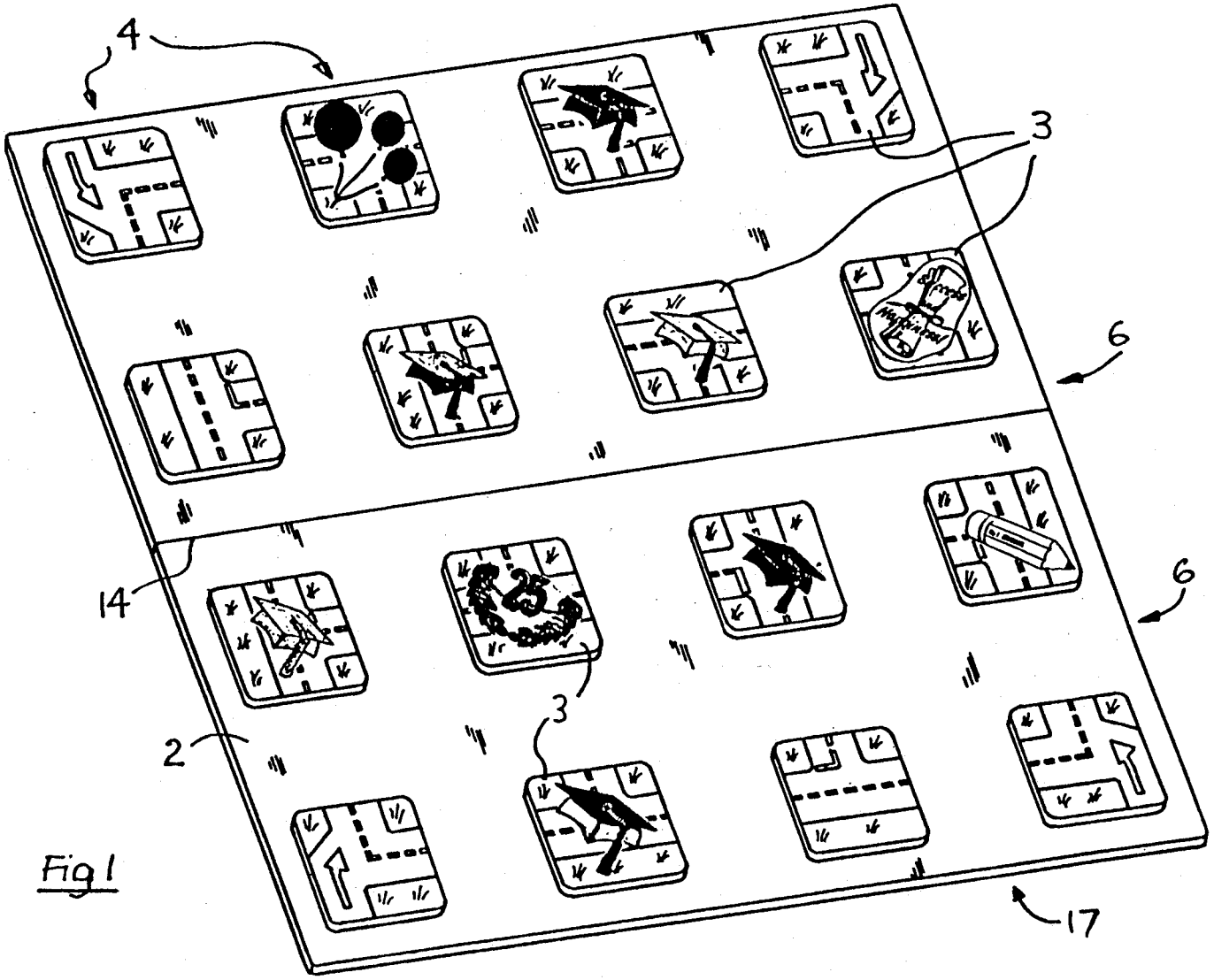
FIG. 1 is a pictorial view of a game board, which is suitable for use in the invention.

The game apparatus shown in the accompanying drawings and described below is an example which embodies the invention. It should be noted that the scope of the invention is defined by the accompanying claims, and not necessarily by features of specific embodiments.

As shown in the drawings, the apparatus for the game comprises: a baseboard 2; fixed tablets 3 which are glued to the baseboard 2 in regular rows 4; movable tablets 5 which are slidable within the corridors 6 left between the rows 4 of fixed tablets 3; a set of target cards 7, movable game counters 8, and a set of game money 9. The baseboard 2 is a 40×40 cm square, 3 mm in thickness, and made of stiff cardboard. The baseboard is hinged, at 14, for convenience of storage.

The fixed tablets 3 are sixteen in number, and are arranged in four rows 4 of four fixed tablets. The movable tablets 5 are thirty-four in number, so that the total quantity of tablets, both fixed and movable, is fifty. Of the fifty, only forty-nine are in play and present on the playing board at a time. Thirty-three of the thirty-four movable tablets 5 are arranged between the fixed tablets, so as to make up a 7×7 square of tablets.

It will be noted that a whole row 15 of seven movable tablets can be moved as a body along the E-W corridor 6. Similarly, the whole row 16 of movable tablets, which lies at right angles to the row 15, can be moved as a body along the N-S corridor 17.

To start the game, each player (up to four) places his game counter 9 in an appropriate corner of the board, and the players draw one card each from the pile 7 of target cards. It is each player's task to observe where, upon the playing board, the tablet is located that bears the target emblem corresponding to the card he has drawn, and it is his task to reach that target tablet with his game counter. As shown, it is preferred for the target emblems to have a flavour of educational achievement.

Figure 2:
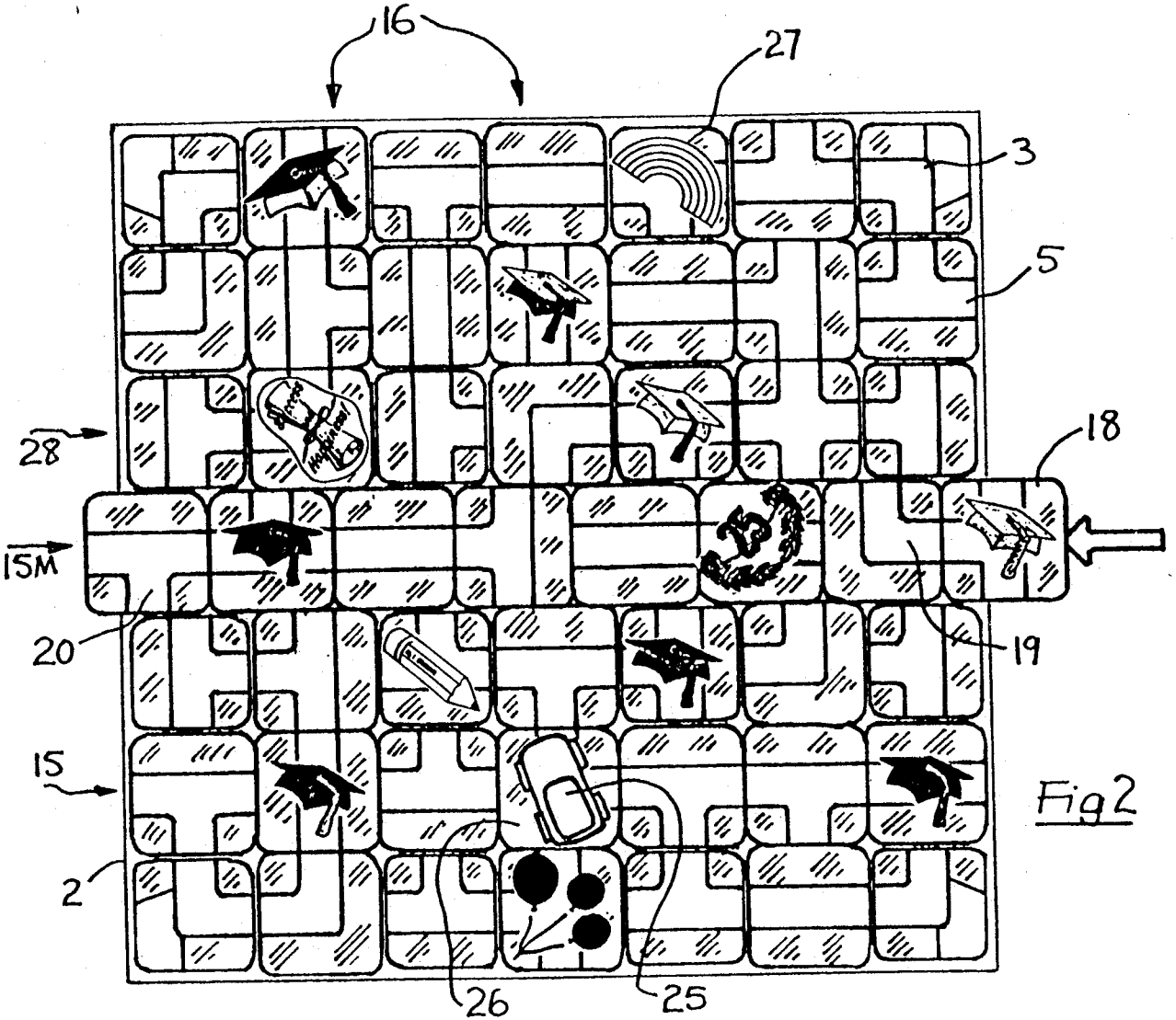
FIG. 2 is a plan view of the board of FIG. 1, to which movable tablets have been added.
Figure 3:
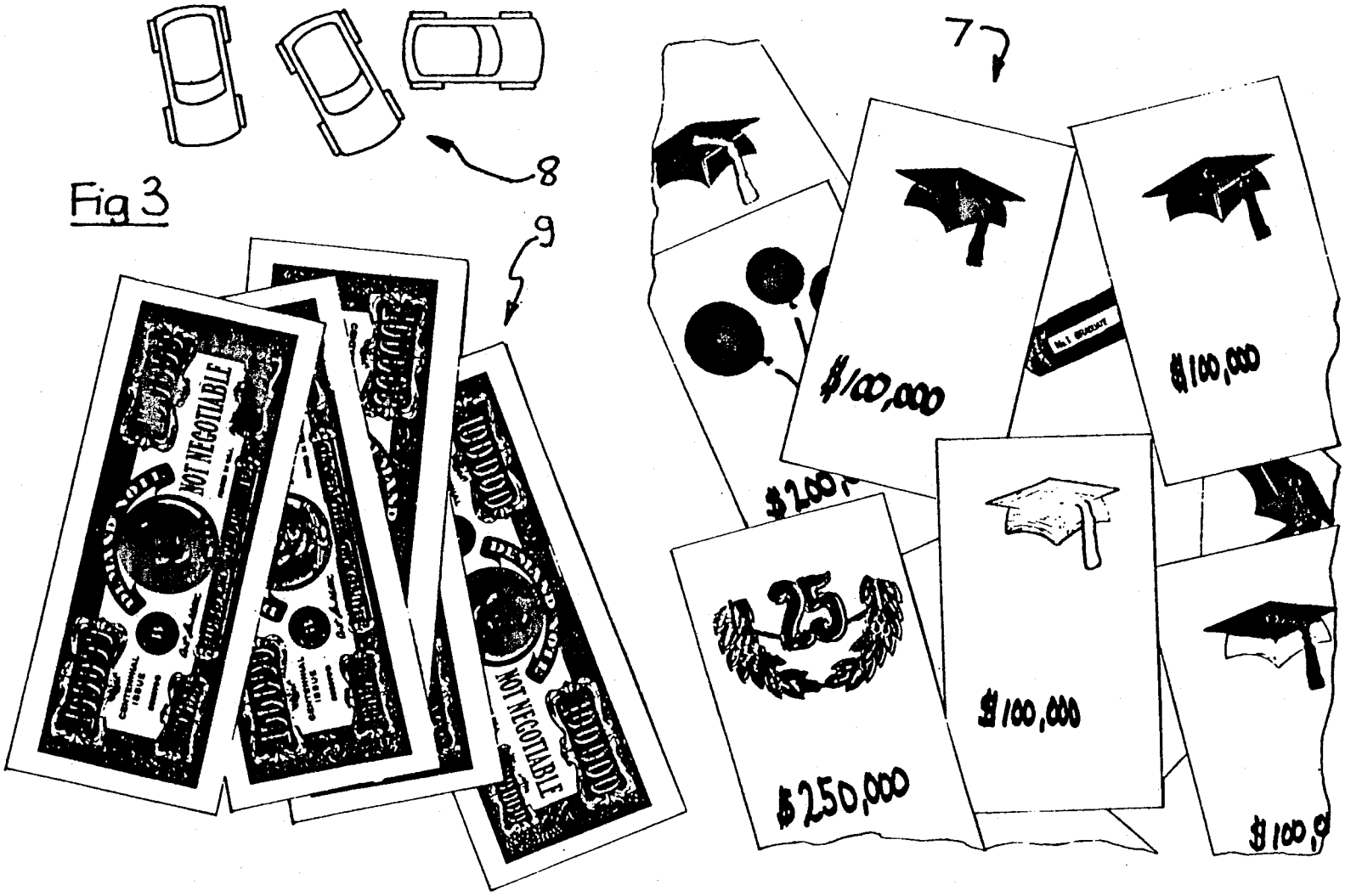
FIG. 3 shows the remaining components of the apparatus that is suitable for use in the invention.
Figure 4:
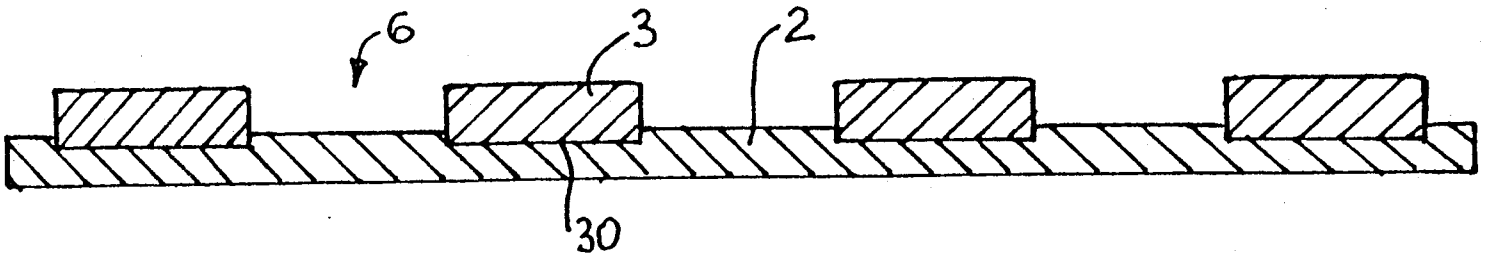
FIG. 4 is a side elevation of the board of FIG. 1.

Player no 1 now takes the remaining movable tablet 18, places it, as illustrated in FIG. 2, against the end tablet 19 of the middle row 15M of the three rows 15 of seven movable tablets (there are six such rows, the three rows 15 lying East-West, and the three rows 16 lying North-South) and he uses the tablet 18 to push the whole row 15M along the corridor 6 until the tablet 20 at the opposite end of the row 15M is pushed out of the playing area, whereupon the movable tablets in the row 15M have each moved one position along the corridor.

Each row of seven movable tablets may be moved either way along its appropriate corridor, so that there are twelve moves altogether available to each player. It is up to the player to decide which of the twelve will be to his best advantage.

Player no 1, having altered one row, is now at liberty to move his game counter 25 along the new road layout that has opened up.

Each player in turn makes an alteration to the rows 15, 16 of movable tablets, in an effort to create a path to his target tablet.

As the game progresses, the game counters become displaced over the playing board, and also, since some of the target tablets are movable tablets, by the time a player has engineered a pathway to the target, the targets may have moved.

To illustrate the procedure, again consider the position shown in FIG. 2, for example: here, a player's game counter 25 is located upon a tablet 26; and this player, as a result of his drawing a particular one of the cards 7, happens to be aiming for the target emblem shown as a Rainbow, which happens to be on the fixed tablet 27.

By pushing the middle East-West row 15M to the left, as shown in FIG. 2, the player is able to create a pathway whereby his game counter 25 can reach the target tablet 26, as will be seen by perusing FIG. 2. Upon reaching the target tablet with his game counter, the player may now show the rest of the players the card 7 he was holding, and may draw the appropriate amount of money from the bank. He then draws a fresh card, and the game continues.

The aim of the game as described is to collect money up to a predetermined amount, the first to do so being the winner. As an added twist, however, it can be stipulated that the player with the money has not actually won the game until his game counter is back to its home starting position. The rest of the players can then try to prevent this player from reaching home, until they too have accummulated the predetermined amount.

Various rules can be made for situations that occur during play, such as: whether counters can "overtake" each other on the roads; or what is done if a counter happens to lie on the tablet 20 that is pushed off the end of an altered row; and so on.

It is preferred that the players only have one target card at a time, but it might alternatively be arranged that the cards are dealt out to the players at the start of the game, and the first to reach all his targets is the winner. The game might even be played without target cards at all, whereby the winner is, say, the first player to check off all the targets.

Similarly, the game alternatively can be played without game money; in that case the score may be kept, for example, by accumulating game cards.

As regards the physical construction of the game components, it is important that the fixed tablets be very accurately positioned on the baseboard. If a fixed tablet should be slightly out of position, or skewed or misaligned in some way, the rows of movable tablets could not slide so freely.

In fact, only quite a small margin for manufacturing misalignment of the fixed tablets can be allowed. The corridors of course do have to be slightly wider than the width of the tablets, but it is important that the clearance or fit between the corridors and the tablets be quite tight. All seven movable tablets in a particular row (e.g. row 15M) are, when the row is being pushed, naturally in end-to-end contact with each other, i.e. with no clearance between the tablets, and it would therefore be most obtrusively noticeable if the immediately adjacent parallel row (e.g. row 28) alongside, made up of both fixed and movable tablets, were spaced out.

On the other hand, inevitably the movable tablets will undoubtedly become as misaligned as they are permitted to become, during play. The corners of the tablets are rounded, to provide some degree of self aligning action as a row is pushed. It has been found, with tablets 5 cm square, a corner radius of about 7 mm is sufficient to ensure that the tablets (almost) always can be manipulated without becoming jammed. A nominal clearance of about 0.5 mm is allowed between an adjacent pair of fixed tablets 3 and the movable tablet 5 between them.

If the movable tablets are made the same nominal size as the fixed tablets, the aggregate length of a row such as row 28, made up of both fixed and movable tablets of the same nominal size, would be about 2 mm longer than the aggregate length of a row made up only of movable tablets, all in contact with each other. Such a small difference as that would not be noticed, but the clearance must not be allowed to become too great.

Alternatively, the fixed tablets can be cut slightly smaller (1 mm or so) than the movable tablets, to compensate for the clearance that must be provided. This is the condition illustrated in FIG. 2.

If the game were to be manufactured with tablets substantially smaller than 5 cm square, the clearance that would have to be provided would be more troublesome, since it would be proportionately larger.

The baseboard 2 is provided with tablet-shaped indentations 30 in its upper surface, into which the fixed tablets 3 may be accurately positioned before glueing. The indentations 30 are pressed in using a suitable jig to ensure positional accuracy. Alternatively, the fixed tablets could be formed integrally with the baseboard, as a unitary plastic moulding for example, or a vacuum-formed plastic item, in which the outlines of the fixed tablet are incorporated into the mould.

For a family board game, the skill level should not be such that players require several minutes of concentrated study to figure out the next move (as in chess, for example). Nor should a family game be such that certain quite simple strategies, once assimilated by even a dull player, will enable the player always to make the best play in a particular game situation, simply by rote.

For a family game, it is preferable that a player should be able to develop his skill level so that he can beat the unskilled player slightly more often than would be determined by simple chance, but only slightly more often. If too much skill is required, some family members will have no chance of winning, and that is not the intention.

The combination of fifty tablets, of which 32 are T-junctions, 9 are elbow-corners, 8 are straight-on, and 1 is a cross-roads, has been found to impose just the right balance between skill and chance.

When two tablets are placed together, there are sixteen possible side-edge to side-edge engagements. When the tablets are both T-junction tablets, nine of these sixteen engagement combinations provide through-roads, the other seven being blanked off. Thus if all the tablets were T-junctions, on average a little over 50% of the tablet-to-tablet engagements would be passable, the rest impassable. When some of the tablets define elbows or straight-ahead roads, the percentage is reduced to about 40% passable.

Forty-nine tablets arranged in a $7 \times 7$ square, have a total of eighty-four edge engagements. For the purposes of the game, it is preferred that of these eighty-four edge engagements, between thirty-five and forty are passable (the actual number depends on the particular arrangement). The above stated mix of T-junction tablets with the other kinds of tablets produces this favourable proportion of passable engagements, on the average.

The effect of this is that on the playing board at any one time there are always several three- and four-tablet pathways open, and some five-tablet pathways.

Hence, during play it constantly appears to a player that he is just on the point of establishing a through road from the tablet his game counter is on to the target tablet, even though when it comes to it he cannot quite make it all the way. It is this aspect of seeming always to be on the brink of a breakthrough, but (almost) never quite achieving it, that makes the game exciting, and maintains interest over a long period of time.

This favourable relationship, in the embodiment described of the invention, between skill, chance, and the players perception of achieving success, mainly arises from the above quoted ratio of passable to impassable pathways. If more pathways were passable, the game would become too easy in that a player would easily establish a path to his target nearly every play. Similarly, if fewer pathways were passable, the game would become too frustrating, and players would lose interest.

The playing board need not be square, but may be rectangular. It is even contemplated that the periphery be not a regular shape at all, but that the several rows might have each a different number of movable tablets. However, the 5 cm tablets arranged in 7×7 rows has been found to give a well-balanced compromise between the skill requirement of the game, and the requirement of manufacturing tolerances that can be readily achieved.

In fact, it is contemplated that the tablets might be triangular, rather than square or rectangular. Triangular movable tablets could be placed in corridors between fixed tablets, such that a whole row of triangular tablets could be pushed bodily from one end of the row. However, the square arrangement as described is superior in almost all respects, and is generally preferred.

Other variations are contemplated, in the invention, as regards the manner of scoring. For example, amounts of money could be marked out on (some of) the tablets, and players could collect those amounts as they pass the particular tablets. Or, tokens could be placed on selected tablets, for the players to pick up in passing.

We claim:

1. Apparatus for a board game, wherein:

the apparatus includes a baseboard, respective movable game counters for each of at least two players, and a series of tablets which are laid out, on the baseboard, adjacent to one another;

the tablets are provided with means defining a pathway pattern, the means being so arranged on the tablets that in respect of some pairs of adjacent tablets a continuous path for the said game counters is defined therebetween, and in respect of other pairs of adjacent tablets, no pathway for the game counters exists therebetween;

some of the tablets are movable, a movable tablet being a tablet that is movable relative to an adjacent tablet and to the baseboard;

some of the tablets are provided with markings designating those tablets as target tablets;

the pathway pattern is such that a player may move his game counter from tablet to tablet along the pattern of pathways towards a selected one of the target tablets;

the apparatus includes a means, operable by a player, for moving the movable tablets;

the arrangement of the apparatus is such that the said movement of the movable tablets gives rise to a fresh pathway pattern;

the apparatus includes fixed tablets, which are fixed to the baseboard;

the fixed tablets are spaced apart in regular rows, with such spacing that corridors are created between the rows of fixed tablets, along which the movable tablets may be moved;

and all the tablets are square.

2. Apparatus of claim 1, wherein the tablets have well-rounded corners.

3. Apparatus of claim 1, wherein the nominal side dimension of the each tablet is 5 cm.

4. Apparatus of claim 1, wherein the fixed tablets are slightly smaller than the movable tablets.

5. Apparatus of claim 1, wherein the apparatus includes sixteen fixed tablets and thirty-four movable tablets.

6. Apparatus of claim 1, wherein the apparatus includes a series of cards, receivable by the players, each carrying a means for identifying one of the targets.

7. Apparatus of claim 1, wherein the apparatus includes game money, for keeping cumulative score of the targets reached by the players.

8. Apparatus of claim 1, wherein the baseboard is of thick carboard, having tablet-shaped indentations pressed into the surface thereof, and the fixed tablets are fitted into the indentations, and are secured therein.

9. Apparatus of claim 1, wherein the means defining a pathway pattern comprises markings which resemble roads marked upon the tablets.

10. Apparatus of claim 9, wherein a substantial proportion of the tablets comprise T-junction tablets, a T-junction tablet being a tablet upon which the road-like markings comprise three roads arranged in a T-junction, the three roads opening onto three of the four side-edges of the square tablet, and the remaining side-edge being closed to the roads marked on that tablet.

11. Apparatus of claim 1, wherein the fixed tablets are so arranged that some of the corridors all lie parallel to a first direction, and the remainder of the corridors all lie parallel to a direction at right angles to the said first direction.

12. Apparatus for a board game, wherein:

the apparatus includes a baseboard, respective movable game counters for each of at least two players, and a series of tablets which are laid out, on the baseboard, adjacent to one another;

the tablets are provided with means defining a pathway pattern, the means being so arranged on the tablets that in respect of some pairs of adjacent tablets a continuous path for the said game counters is defined therebetween, and in respect of other pairs of adjacent tablets, no pathway for the game counters exists therebetween;

some of the tablets are provided with markings designating those tablets as target tablets;

the pathway pattern is such that a player may move his game counter from tablet to tablet along the pattern of pathways towards a selected one of the target tablets;

the apparatus includes a means, operable by a player, for moving the movable tablets;

and the arrangement of the apparatus is such that the said movement of the movable tablets gives rise to a fresh pathway pattern;

the apparatus includes fixed tablets, which are fixed to the baseboard;

the fixed tablets are spaced apart in regular rows, with such spacing that corridors are created between the rows of fixed tablets, along which the movable tablets may be moved;

and the movable tablets are co-planar with the fixed tablets, and said movable tablets are slidable on said baseboard and slide along said corridors.

13. Apparatus of claim 12, wherein all the tablets are square.

* * * * *